US005465479A

United States Patent [19]

Bowen et al.

[11] Patent Number: 5,465,479

[45] Date of Patent: Nov. 14, 1995

[54] LOCATING FIXTURE SYSTEM FOR ELECTRICAL CONNECTORS

[75] Inventors: David C. Bowen; Frank A. Harwath, both of Downers Grove; Irvin R. Triner, Willowsprings, all of Ill.

[73] Assignee: Molex Incorporated, Lisle, Ill.

[21] Appl. No.: 223,917

[22] Filed: Apr. 6, 1994

[51] Int. Cl.[6] ..... H01R 43/01

[52] U.S. Cl. ..... 29/749; 29/760

[58] Field of Search ..... 29/748, 749, 758, 29/760, 464, 566.4, 751, 753, 861

[56] References Cited

U.S. PATENT DOCUMENTS

| | | | |
|---|---|---|---|
| 4,005,518 | 2/1977 | Bakermans | 29/749 X |
| 4,048,710 | 9/1977 | Nijman | 29/749 X |
| 4,505,034 | 3/1985 | Reidt | 29/749 |
| 4,554,733 | 11/1985 | Caveney | 29/749 |

FOREIGN PATENT DOCUMENTS

| | | | |
|---|---|---|---|
| 0066060 | 12/1982 | European Pat. Off. | 29/749 |
| 0149911 | 7/1985 | European Pat. Off. | 29/749 |

*Primary Examiner*—Peter Vo
*Attorney, Agent, or Firm*—A. A. Tirva

[57] ABSTRACT

A locating fixture system is provided for aligning a multi-conductor flat electrical cable with an elongated electrical connector having a plurality of terminals for termination to the conductors of the cable. A fixture base defines a cable platform for supporting the multi-conductor flat electrical cable. A receptacle in the base receives the elongated electrical connector generally transversely of the cable, with the terminals projecting above the cable platform for termination to the conductors of the cable. A locating pin is provided on the base within the receptacle for insertion into a locating hole in the connector intermediate opposite ends of the connector for properly locating the connector transversely of the cable.

12 Claims, 2 Drawing Sheets

LOCATING FIXTURE SYSTEM FOR ELECTRICAL CONNECTORS

FIELD OF THE INVENTION

This invention generally relates to the art of electrical connectors and, particularly, to a fixture system for locating and aligning an elongated electrical connector with a flat, flexible multi-conductor electrical cable.

BACKGROUND OF THE INVENTION

Multi-conductor flat electrical cables are used in a variety of applications, such as in computer, telecommunications and similar apparatus. The flat cables are connected to other cables, the electrical apparatus, printed circuit boards and the like by means of electrical connectors which are elongated transversely of the cables.

Such a connector conventionally includes an elongated dielectric body which mounts a plurality of terminals which have staggered rows of U-shaped contact elements spaced to correspond to the spacing of the cable conductors. Typically, the conductors are individually insulated and joined together by a solid dielectric plastic material, with the conductors in a flat, flexible unitary array, and with the surface of the cable being undulated to define closely spaced ribs running lengthwise of the cable.

Each contact element of each terminal of the connector typically is bifurcated to define parallel legs which pierce the cable insulation as an individual conductor is forced into a slot between the legs. A cover usually is used to force the conductors into the contact elements and maintain the conductors in the slots thereof. The ends of the terminals opposite the contact elements and the connector body have various shapes depending upon the application of the connector or the apparatus to which the cable is to be connected.

The connector is assembled to the cable by aligning the individual conductors with the individual contact elements of the terminals. The cover is forced into assembled position relative to the connector body in a press, such as a bench press, to force the conductors into the contact elements. In order to align the conductors with the contact elements and to align the connector, generally, with the cable, a fixture normally is used in the press.

Typically, such fixtures include a base having adjustable connector locating guides and adjustable cable guides mounted on the base, along with conductor positioning grooves in a top surface of the base for receiving the undulated surface of the cable. In essence, the grooves accommodate the conductors of the cable for final positioning and for holding the cable during termination. Heretofore, construction of this type of fixture has been done by machining a metal plate, along with other components of the fixture, which are expensive processes.

Another problem with aligning fixtures of the character described above involves the precision required to locate the connector transversely of the cable to ensure that the tiny contact elements are terminated to the proper cable conductors. A single connector may have many contact elements, and the conductors of the cable may have a spacing of 0.025 inches or less. If the connector is aligned by means located at one or the other end of the connector, the tolerance build-up along the length of the connector is considerable, which often results in misalignment the further the contact elements or conductors are away from the aligning means.

This invention is directed to solving these problems in an improved locating fixture system of the character described.

SUMMARY OF THE INVENTION

An object, therefore, of the invention is to provide a new and improved locating fixture system for aligning a multi-conductor flat electrical cable with an elongated electrical connector having a plurality of terminals for termination to the conductors of the cable.

In the exemplary embodiment of the invention, the locating fixture system includes a base which defines a cable platform for supporting the multi-conductor flat electrical cable. A receptacle is provided in the base for receiving the elongated electrical connector generally transversely of the cable, with the terminals projecting towards the cable platform for termination to the conductors of the cable. Complementary interengaging locating means are provided between the base and the electrical connector, intermediate opposite ends of the connector, for properly locating the connector transversely of the cable.

As disclosed herein, the complementary interengaging locating means are located equidistant from the opposite ends of the connector. The means include a pin projecting from inside the receptacle for insertion into a hole in the connector. Preferably, the base is fabricated of plastic material, die cast metal material or the like.

Another feature of the invention is the provision of a hold down clip mounted on the base on at least one side of the receptacle for resiliently clamping the cable onto the cable platform. In the preferred embodiment, one of the hold down clips is mounted on each opposite side of the receptacle.

A further feature of the invention is the provision of aligning grooves in the cable platform for accommodating the undulations formed lengthwise of the cable by the conductors of the cable. In the preferred embodiment of the invention, the aligning grooves are provided in an area less than one-third of the width of the cable and generally centrally between the sides of the cable, again for preventing tolerance build-up.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
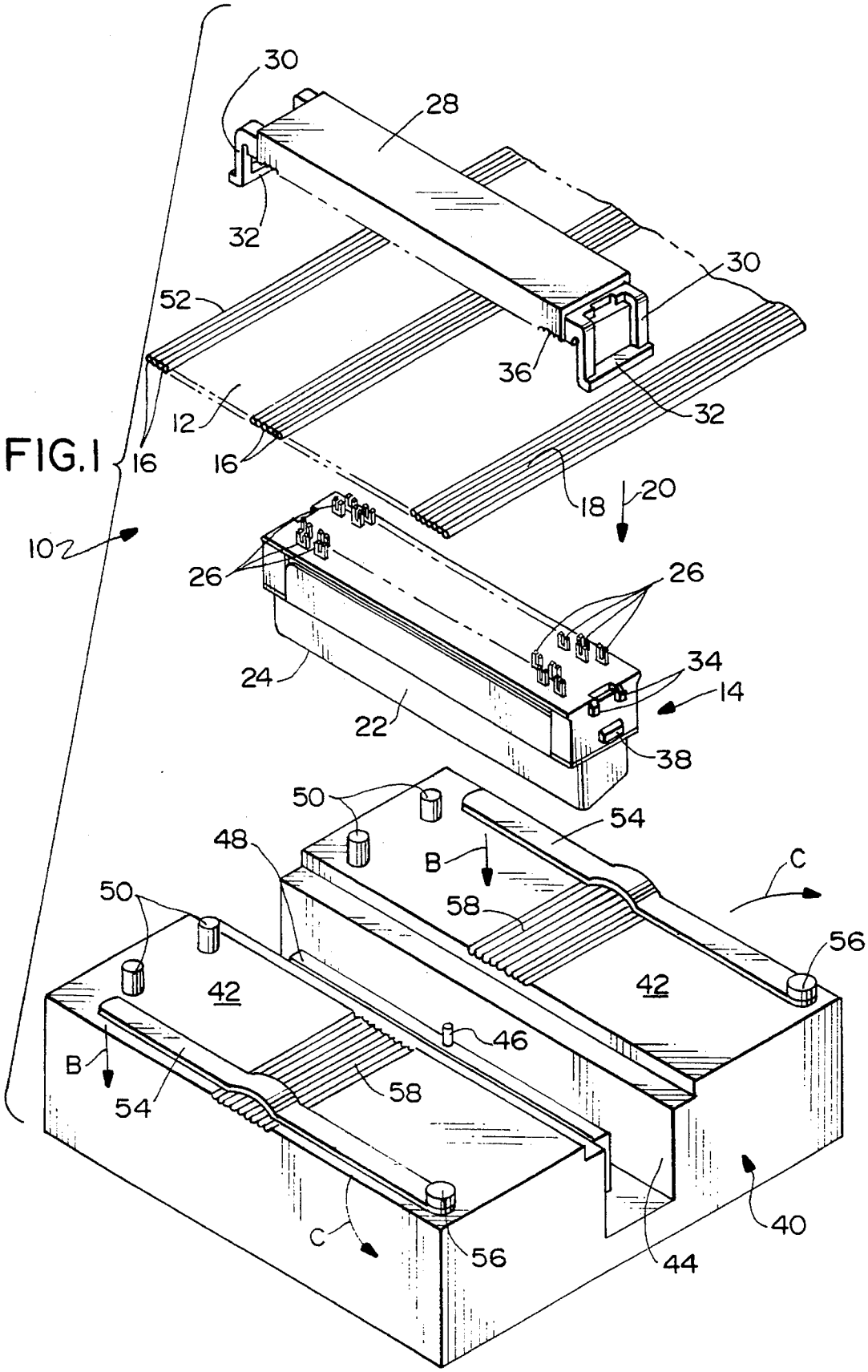
FIG. 1 is an exploded perspective view of the locating fixture system of the invention.

Referring to the drawings in greater detail, and first to FIG. 1, the invention is directed to a locating fixture system, generally designated 10, for aligning a multi-conductor flat electrical cable 12 with an elongated electrical connector, generally designated 14.

Cable 12 is of a conventional construction and includes a plurality of individual insulated electrical conductors 16 in a flat, flexible unitary structure. In essence, the cable is a solid structure of parallel conductors joined together and insulated from each other by an insulating material, such as plastic or the like. This unitary structure defines undulated surfaces 18 on opposite sides of the cable. The undulated surfaces form closely spaced ribs running lengthwise of the cable.

Connector 14, except for its locating means described hereinafter, is of a typical construction and includes a dielectric body 20 of plastic material or the like. The connector is elongated generally transversely of the cable as shown in FIG. 1. A metal shield 22 surrounds a considerable portion of dielectric body 20, particularly about a mating end 24 of the connector. As is known, the body mounts a plurality of terminals for termination to conductors 16 of cable 12. The terminals define an array of staggered rows of U-shaped contact elements 26 spaced to correspond to the spacing of the cable conductors. Each contact element is formed with forked parallel legs, as shown, which pierce the cable insulation as a respective conductor is forced into a slot formed by the forked parallel legs. As seen in FIG. 1, two pairs of staggered rows of contact elements 26 are provided. There are thirty four contact elements in each of the pairs of staggered rows but there could be more. The adjacent contact elements have a spacing of 0.025 inches or less.

An elongated connector cover 28 is assembled to connector 14 by means of a pair of latch arms 30 at opposite ends of the cover. The cover is unitarily molded of dielectric material, such as plastic or the like, and latch arms 30 have latch bars 32 which resiliently snap behind pre-positioning bosses 34 at opposite ends of connector body 20. These pre-positioning bosses locate the cover spaced from the connector body to allow free movement of cable 12 therebetween. The underside of cover 28 is undulated, as at 36, to match the undulated surface 18 of the cable. In final assembly, cover 28 is forced downwardly in a press, such as a bench press, in the direction of arrow "A" until latch bars 32 snap behind latch bosses 38 at opposite ends of connector body 20. This pressing action sandwiches cable 12 between the cover and the connector body, forcing conductors 16 into the U-shaped contact elements 26 and thereby terminate the conductors of the cable to the terminals of the connector.

Figure 2:
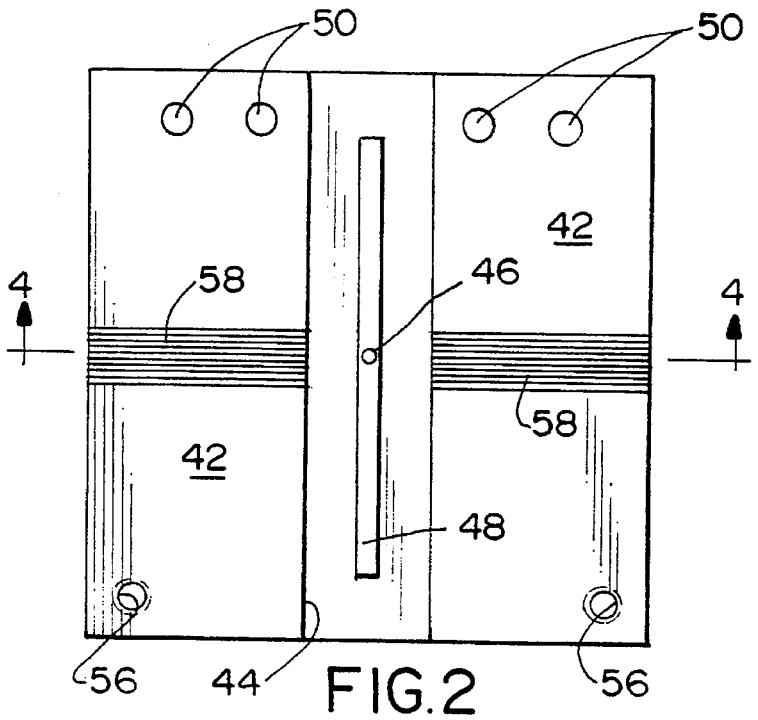
FIG. 2 is a top plan view of the fixture base.
Figure 3:
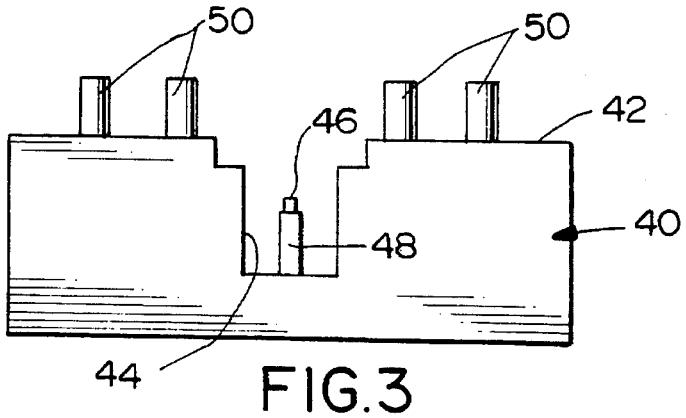
FIG. 3 is a side elevational view of the fixture base.

Referring to FIGS. 2 and 3 in conjunction with FIG. 1, the locating fixture system of the invention includes a fixture base, generally designated 40, which defines a cable platform 42 for supporting the multi-conductor flat electrical cable 12. The fixture base includes a receptacle 44 for receiving elongated electrical connector 14 generally transversely of the cable such that contact elements 26 of the terminals project towards the cable platform 42 for termination to conductors 16 of the cable, as will be seen hereinafter.

Generally, complementary interengaging locating means are provided between fixture base 40 and connector 14, intermediate opposite ends of the connector, for properly locating the connector within receptacle 44 transversely of the cable. In particular, a locating pin 46 projects upwardly from a rib 48 which extends longitudinally of receptacle 44, the rib extending transversely of a cable. Pin 46 is located generally centrally or at a mid-point of rib 48. When locating connector 14, the pin preferably is at a mid-point equidistant from opposite ends of the connector.

Further features of fixture base 40 include a pair of side locating pins 50 which project upwardly on each opposite side of receptacle 44. Pins 50 are engageable by a side edge 52 (FIG. 1) of cable 12 to roughly locate the cable transversely of the fixture and, thereby, longitudinally of a located connector 14.

Fixture base 40 also includes a pair of hold down clips 54 which are pivotally mounted on cable platform 42 by pivot pins 56. The hold down clips are fabricated of a resilient material, such as metal or the like, so as to be capable of being spring loaded to apply a downward pressure in the direction of arrows "B" to thereby hold cable 12 down onto cable platform 42. The hold down clips can be pivoted about pivot pins 56 in the direction of arrows "C" to "open" cable platform 42 and allow a cable to be positioned thereon. The hold down clips then can be pivoted in a direction opposite arrows "C" to positions overlying the cable and to resiliently bias the cable onto platform 42.

Still further, base fixture 40 includes a plurality of aligning grooves 58 formed in cable platform 42 for accommodating the undulated surface 18 of flat cable 12. Grooves 58 extend lengthwise of the cable and, in essence, receive the conductors of the cable. Pin 46 is located generally at mid-point of grooves 58. It can be seen that the aligning grooves do not extend completely across the cable platform transversely of the fixture base. This is to prevent "tolerance build-up" across the entire surface which might prevent grooves 58 from matching or accommodating the undulations formed by the flat cable. In the preferred embodiment, aligning grooves 58 are provided in an area no greater than one-third the width of the cable and generally centrally between the sides of the cable.

Figure 4:
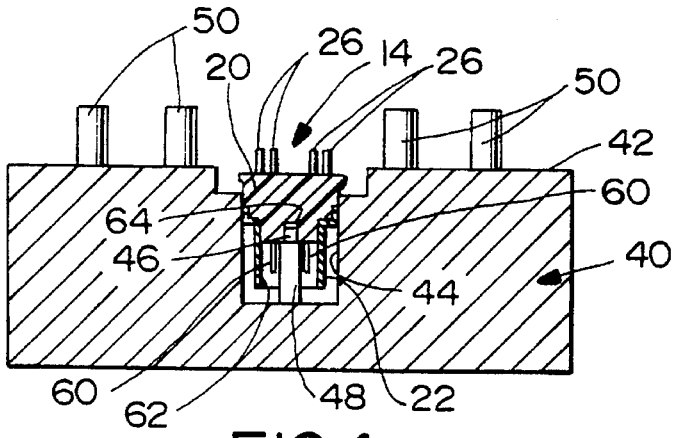
FIG. 4 is a vertical section taken generally along line 4—4 in FIG. 2, with the connector mounted in the receptacle of the fixture base.

Referring to FIG. 4, it can be seen that connector 14 is positioned within receptacle 44 of fixture base 40 such that connector body 20 is located below cable platform 42 of the base, but contact elements 26 project upwardly towards the platform for termination to conductors 16 of cable 12, as described above. The terminals of the connector include mating portions 60 projecting from body 20 into a cavity 62 within shield 22. Rib 48 of the fixture base projects upwardly between two rows of the mating portions 60 of the terminals and locating pin 46 projects into a locating hole 64 formed in the underside of connector body 20. As stated above, locating pin 46 and, thereby, hole 64, is positioned intermediate opposite ends of connector 14 to prevent tolerance build-up from one end of the connector to the other. In the preferred embodiment, hole 64 is formed equidistant from opposite ends of the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A locating fixture system for aligning a multi-conductor flat electrical cable with an elongated electrical connector having a plurality of terminals for termination to the conductors of the cable, comprising:

a fixture base defining a cable platform for supporting said multi-conductor flat electrical cable;

a receptacle in the base for receiving said elongated electrical connector generally transversely of the cable with the terminals projecting towards the cable platform for termination to the conductors of the cable;

complementary interengaging locating means between the base and the electrical connector intermediate opposite ends of the connector for properly locating the connector transversely of the cable; and wherein said complementary interengaging locating means comprises a single pin projecting from inside said receptacle for insertion into a single hole in the connector; and said hole is located equidistant from said opposite ends of the connector.

2. The locating fixture system of claim 1 wherein said base is fabricated of plastic material.

3. The locating fixture system of claim 1 wherein said base is fabricated of die cast metal material.

4. The locating fixture system of claim 1, including a plurality of aligning grooves in the cable platform for accommodating undulations formed lengthwise of the cable by the conductors of the cable; and wherein said aligning grooves are provided in an area less than one-third the width of the cable and generally centrally between the sides of the cable.

5. The locating fixture system of claim 4, including a hold down clip mounted on the base on at least one side of the receptacle for resiliently clamping the cable onto the cable platform for maintaining said conductors of the multi-conductor flat cable in the aligning grooves.

6. The locating fixture system of claim 5, including one of said hold down clips mounted on each opposite side of the receptacle.

7. A locating fixture system for aligning a multi-conductor flat electrical cable with an elongated electrical connector having a plurality of terminals for termination to the conductors of the cable, comprising:

a fixture base defining a cable platform for supporting said multi-conductor flat electrical cable;

a receptacle in the base for receiving said elongated electrical connector generally transversely of the cable with the terminals projecting towards the cable platform for termination to the conductors of the cable;

a single locating pin projecting from inside said receptacle intermediate opposite ends of the receptacle;

a single locating hole in the connector located at mid-point of said connector for receiving said locating pin; and a plurality of aligning grooves in the cable platform for accommodating undulations formed lengthwise of the cable by the conductors of the cable, the aligning grooves being limited to an area intermediate opposite sides of the cable and considerably less than the width of the cable.

8. The locating fixture system of claim 7 wherein said aligning grooves are provided in an area less than one-third the width of the cable and generally centrally between the sides of the cable.

9. The locating fixture system of claim 7, including a hold down clip mounted on the base on at least one side of the receptacle for resiliently clamping the cable onto the cable platform for maintaining conductors of said cable in the aligning grooves.

10. The locating fixture system of claim 9, including one of said hold down clips mounted on each opposite side of the receptacle.

11. The locating system of claim 7, including at least two locating pins projecting upwardly from the cable platform on opposite sides of the receptacle for roughly locating the cable with respect to the elongated connector.

12. The locating fixture system of claims 4 or 8 wherein said projecting pin is located generally at mid-point of said aligning grooves.

* * * * *